United States Patent [19]

McKee et al.

[11] Patent Number: 4,461,172

[45] Date of Patent: Jul. 24, 1984

[54] WELL MONITORING, CONTROLLING AND DATA REDUCING SYSTEM

[75] Inventors: Charles B. McKee; Duane B. McKee, both of Fort Collins, Colo.; H. Kent Wainwright, Laramie, Wyo.

[73] Assignee: Inc. In-Situ, Laramie, Wyo.

[21] Appl. No.: 381,030

[22] Filed: May 24, 1982

[51] Int. Cl.[3] ..... E21B 47/10

[52] U.S. Cl. ..... 73/155; 166/250

[58] Field of Search ..... 73/155, 38; 364/422; 166/250

[56] References Cited

U.S. PATENT DOCUMENTS 3,877,301 4/1975 Jensen, Jr. ..... 73/155

4,142,411 3/1979 Deal ..... 73/155

OTHER PUBLICATIONS

"New Instrument Expands Water Well Technology", by Joe L. Mogg, from The Johnson Drillers Journal, dated May-Jun., 1977.

*Primary Examiner*—Jerry W. Myracle

[57] ABSTRACT

An apparatus is provided for gathering monitored data from one or more selected wells of a number of wells and reducing the monitored data in a real time manner to a useful form for analysis by one skilled in ground water evaluation. The apparatus can also be used to control the discharge rate of well water to further assist in the analysis of the characteristics of the selected wells. The apparatus is an integrated system which includes a computer, a number of inter-communicating modules, probes inserted in the wells for sensing water level, and a flow meter for use in measuring water flow rate. A control module directly interfaces with the computer and controls the sending of control and data information to and from the computer. A pump/flow module communicates with the control module and is used in controlling the discharge rate of water from a selected well operatively joined to a pump. An A/D module also communicates with the control module and is used to convert data from a selected well into digital form for use by the computer. Input modules interface between the probes and the A/D module to provide a compatible input to the A/D module.

16 Claims, 7 Drawing Figures
Microfiche Appendix Included
(1 Michrafiche, 41 Pages)

WELL MONITORING, CONTROLLING AND DATA REDUCING SYSTEM

A microfiche appendix is included in this application and consists of one microfiche have 41 frames.

1. Field of the Invention

The present invention relates to a system for monitoring certain characteristics and automatically controlling desired functions associated with the drawdown of water in wells and this invention also relates to a reduction of drawdown data at the same time the data is gathered as a result of the monitoring operation.

2. Background Art

The monitoring of the drawdown of water in a well is recognized as an important operation for better understanding the characteristics of a well. Basically, drawdown can be defined as the distance a water level has changed with respect to a reference water level. Drawdown is typically measured as a function of time. Proper analysis of the drawdown characteristics of a well can provide pertinent information regarding well formation properties including the permeability of the well. In addition to evaluating the permeability of a well by means of an analysis of drawdown, it is also of value to determine the performance or efficiency of a well by varying the discharge rate of water from the well. Whether water in the well can be discharged at a selected rate provides an indication of the development of the well.

In systems used prior to the present invention, drawdown related data is found and accumulated as a function of time using a system for monitoring and receiving data. This accumulated or previously generated drawdown data is eventually transferred to another system which is capable of providing, for example, logarithmic plots or graphs of the drawdown related data. This approach does not lend itself to a rapid and immediate interpretation of accumulated drawdown data. Furthermore, transfer of the data to a separate system for reducing the drawdown data to a desired form can be unwieldly and tedious.

The system of the present invention obviates these difficulties by providing a real-time evaulation of the data as it is received by the system from devices which supply monitored parameters. The data is immediately reduced to an intelligible form so that a hydrologist or one skilled in the ground water field can analyze the reduced data to provide a more rapid determination of well characteristics. This real time analysis is provided using a specially devised interface for coupling the monitored data to a computer having a processing unit. The present invention also provides the capability, not found in previous systems, of automatically controlling the water discharge rate from a well. This feature permits the discharge rate to be held at a constant level or, alternatively, permits a system operator or user to vary, at predetermined times, the discharge rate of water from a well.

PRIOR ART STATEMENT

The following are provided in accordance with the provisions of 37 C.F.R. 1.97–1.99 and are believed to represent the closest prior art:

U.S. Pat. No. 4,142,411 to Deal describes an apparatus for measuring the drawdown of water from a well. The apparatus includes a sensor for providing data to an electronic measuring unit which outputs drawdown measurements.

Publication entitled "New Instrument Expands Water Well Technology", by Joe L. Mogg, from "The Johnson Drillers Journal", dated May-June, 1977 describes a portable instrument for use in providing well water drawdown data.

DISCLOSURE OF THE INVENTION

In accordance with the present invention, a hydrologic instrument apparatus is provided. The apparatus includes a computer and a number of modules operatively coupled together. A control module communicates with the computer through an interface bus and is used to control the transfer of command information and data from the computer to the other modules. The control module is also used in controlling the acceptance by the computer of monitored data inputted to the control module by an analog/digital (A/D) module and a pump/flow module. The A/D module also communicates with one or more input modules which are used to provide a compatible input to the A/D module. These input modules are connected to probes which output analog information relating to the drawdown of a well into which the probes are placed. The pump/flow module is used in determining the period of a flow signal, which relates to the discharge rate of water from a selected well. The pump/flow module is also used in connection with controlling the opening and closing of a valve in order to regulate the discharge of water from the well in which the pump is located. The computer receives the monitored data from the A/D module and pump flow module and simultaneously utilizes the data to provide a visual display or print-out in a format that is immediately useful to a professional skilled in the ground water field.

In view of the foregoing description, a number of worthwhile objectives of the present invention can be achieved. The system disclosed herein includes a number of modules and a computer which properly interface with sensing or monitoring devices to provide a unitary apparatus for gathering significant amounts of data and reducing that data in a real time manner so that the data is available to a skilled drawdown technician in a desired format at the same time the data is received. Because of the present invention, drawdown related data need not be found by one apparatus and then transferred to another separate apparatus for reducing the data at another time. Also with the system of the present invention, the obtained data can be immediately provided in a desired, useful form. In addition, the present invention is able to automatically control the rate of discharge of water from a selected well having a pump operably connected thereto. In addition, a system operator can vary the discharge rate and gather data relating to different discharge rates for use in analyzing the development of the well.

Additional advantages of the present invention will become readily apparent from the following discussion, taken in conjunction with the accompanying drawings.

DESCRIPTION OF THE PREFERRED EMBODIMENT

Figure 1:
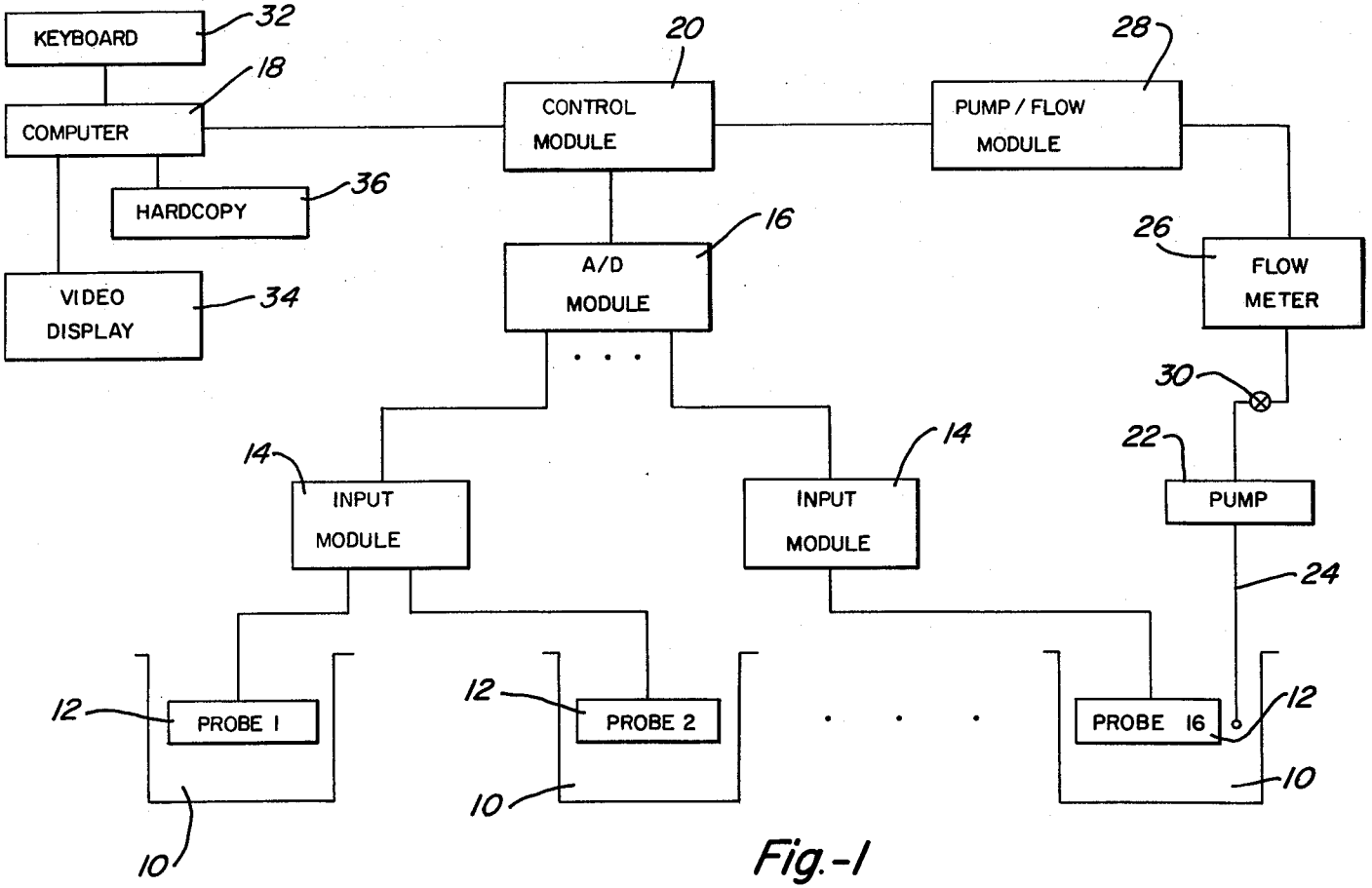
FIG. 1 is a schematic block diagram showing the system of the present invention.

In accordance with the present invention, FIG. 1 is a block diagram schematically illustrating a system for gathering and reducing data associated with well water drawdown. The system is intended to be used with a number of wells, each well preferably having the same aquifer for supplying water to the well. Sixteen wells are illustrated in FIG. 1, although it is understood that any number of wells could be monitored.

Each of the sixteen wells 10 receives a probe 12 for placement in each well at a desired depth of water. In a typical embodiment, each probe is a commercially available device identified having part number 601456 of Senso-Metrics of Van Nuys, California. The probe 12 provides an output in the form of a current in the range of 4 ma–20 ma. In one embodiment, four milliamps of current corresponds to a water pressure of zero psi while twenty milliamps of current corresponds to a water pressure of fifty psi. Since the amount of current generated by each probe 12 is proportional to the water pressure at which the probe 12 is located, any water pressure sensed between zero psi and fifty psi will proportionately result in a current between four milliamps and twenty milliamps. The present system also permits an operator to vary the outer limit of the psi range. Specifically, the operator may input a water pressure of greater than fifth psi so that the twenty milliamps of current will correspond to that inputted psi.

The current output of the probe 12 is applied to an input module 14. One input module 14 receives current outputs from four probes 12. In the case of 16 wells each having a separate probe 12, four input modules 14 are provided. The input modules 14 convert the output current of the probe 12 to a voltage in the range of −4 to +4 volts so that the voltage produced can be transmitted to and properly received by an A/D module 16. The A/D module 16 is used in selecting one of the 16 outputs from the input modules 14 and for converting the analog voltage information therefrom to a digital form. The selection of a well 10 is made utilizing computer 18 through a control module 20. The computer 18 and control module 20 control the sequence and direction of commands and data in the system. In this regard, the control module 20 controls the addressing of modules by the computer 18 so that information requested by the computer 18 will be transferred thereto from the modules and information to be sent to the modules will be properly transmitted thereto from the computer 18.

In addition to providing data by means of the probes 12 for use in determining the drawdown of water in wells 10, the rate of discharge of water from a well 10 is monitored. A pump 22 is operatively joined to a well 10 through a pipeline 24. A flow meter 26 measures the rate of water flow as water moves therethrough. The flow meter 26 outputs a flow signal. The frequency of the flow signal is proportional to the flow rate of the water. The flow signal is sent to a pump/flow module 28. The pump/flow module 28 is used in determining the period of the inputted flow signal. Using the period of the flow signal, the computer 18 is able to calculate the frequency of the flow signal. From the frequency, the flow rate of the water through the flow meter 26 is determined. A flow meter which may be used is a "Water Flood Meter" made by Halliburton of Duncan, Okla.

A valve 30 is also provided in the system. The opening and closing of the valve 30 is controlled by the computer 18. The water flow rate can be automatically regulated to a desired constant level. If a predetermined flow rate is not present, the valve opening is increased or decreased, depending upon whether the predetermined flow rate is greater than or less than the actual measured flow rate. A valve which may be used is an "Electric Diaphragm Valve" made by Asashi-America of Medford, Mass.

A keyboard 32 communicates with the computer 18 and is used to input desired information or parameters to the computer 18 prior to gathering the monitored data. A video display 34 is able to output a visual display of plots or graphs using the drawdown and flow rate data. A hardcopy device 36, such as a printer, is able to provide a permanent record of pertinent well water information.

The computer 18 has a number of software instructions used to reduce the data provided by the probes 12 and/or flow meter 26 to a form useful by hydrologists or those skilled in ground water analysis. Software is provided to continuously determine the drawdown of a selected well, based on the water pressure change as a result of water being pumped from the selected well or a well having the same aquifer. The drawdown data is used in a real time manner to immediately produce plots which can be used by the hydrologist. In this regard, logarithmic plots are generated utilizing drawdown as a function of time. These logarithmic plots can be interpreted by the hydrologist so that an opinion can be rendered regarding the characteristics or performance of the selected well. These generated plots can also be immediately compared with "type curves", which illustrate characteristics of reference or typical wells.

Software is also provided to determine the flow rate of water being pumped from a well 10 and is used in controlling the opening or closing of the valve 30. Software also properly utilizes parameters inputted to the computer 18 through the keyboard 32. Such parameters include: identifying of one or more wells 10 to be monitored; selecting a duration for gathering data while the pump 22 is activated; selecting a duration for gathering data during the well recovery period after the pump 22 is deactivated; providing a sampling rate for monitoring data; and choosing a discharge rate for the water during the pumping cycle.

The software utilized in the present invention and a flow chart thereof are provided in a microfiche copy filed with this application and identified as the microfiche appendix. The microfiche appendix includes program instructions for reducing drawdown data as a function of time to logarithmic plots of drawdown, and for determining whether a desired discharge rate is present and, if not present, software is used, in conjunction with the hardware, for controlling the valve 30.

Using the inputted parameters, the present system provides the capability of real time data reduction, the capability of continuously maintaining a predetermined water discharge rate, and the capability of automatically providing different discharge rates. Based on these capabilities, desired characteristics of a well can be found including its degree of permeability and the ability of the well to discharge water at any number of different flow rates.

Figure 2:
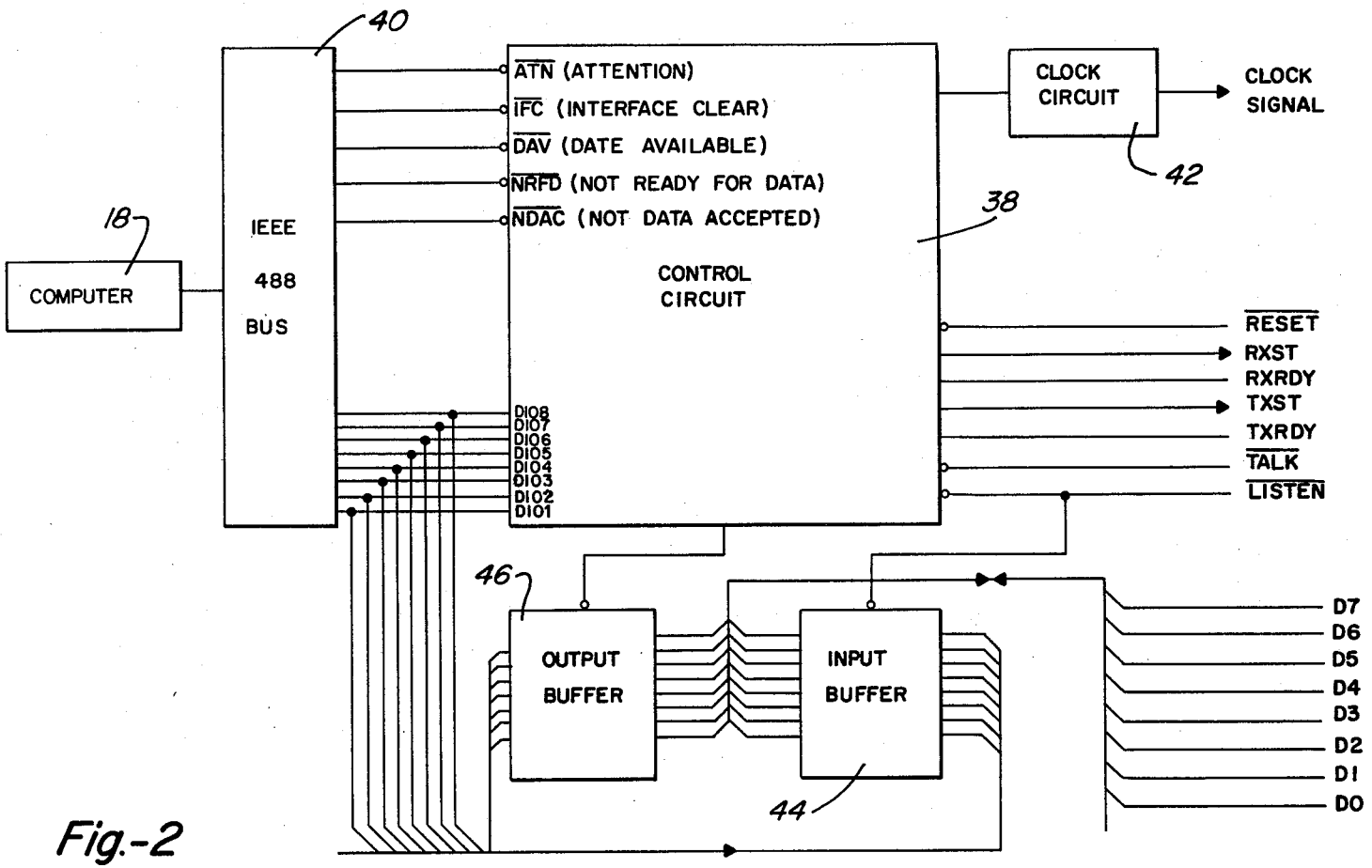
FIG. 2 is a schematic block diagram showing details of the control module of the present invention.

To complete the understanding of the present invention, reference is now made to FIGS. 2–7 which show in greater detail the hardware employed in providing the foregoing capabilities. As seen in FIG. 2, the control module 20 includes a control circuit 38 which is, preferably, a Fairchild chip having part number 96LS488. The control circuit 38 is primarily used to provide control signals and signal handshaking between the computer 18 and the A/D module 16 and the pump/flow module 28. Control signals available in the control circuit 38 and used in the present invention include $\overline{\text{ATN}}$ (attention) which is driven by the computer 18 and is used by the computer 18 when setting up the data bus. If the attention line is a logic HIGH, digital bits on the data bus are data information. If the attention line is a logic LOW when the computer 18 is sending information on the data bus, digital bits on the bus are interpreted as bus set up commands such as whether the computer 18 is sending information or receiving information. $\overline{\text{IFC}}$ (interface clear) is driven by the computer 18 to a logic LOW in order to initialize all devices on the data bus. $\overline{\text{DAV}}$ (data available) is enabled by the computer 18 or module providing data to the data bus. $\overline{\text{NRFD}}$ (not ready for data) is controlled by the computer 18 or one of the modules providing data to the data bus. $\overline{\text{NRFD}}$ (not ready for data) is controlled by the computer 18 or one of the modules to inform the computer or module sending data to hold that data on the data bus since the computer 18 or module, whichever one is to receive the data, is not ready. $\overline{\text{NDAC}}$ (not data accepted) is also controlled by the computer 18 or one of the modules to inform the device sending data to the computer 18 or one of the modules that it is ready for data or command information or, alternatively, that the data sent by the device has been accepted.

The control circuit 38 also directs data bits between the computer 18 and the modules, as represented by DI01–DI08. Both control and data signals are sent to a standard IEEE 488 bus 40 which properly interfaces with the computer 18. In the preferred embodiment, computer 18, keyboard 32, video display 34 and hardcopy device 36 comprise a computer system identified as a Hewlett-Packard HP85F.

A clock circuit 42 communicates with the control circuit 38 and includes a piezo element for generating a clock signal at a desired frequency. In this embodiment, the clock circuit 42 also includes a divider circuit and the clock signal generated has a frequency of 2.5 MHz. An input buffer 44 and an output buffer 46 are also connected to the control circuit 38. The input buffer 44 together with the control circuit 38 control the transmission of data bits D0–D7 to the computer 18 from the selected one of the modules. The output buffer 46, together with the control circuit 38, controls the transmission of data bits DI01–DI08 from the computer 18 to the selected one of the modules.

Figure 3:
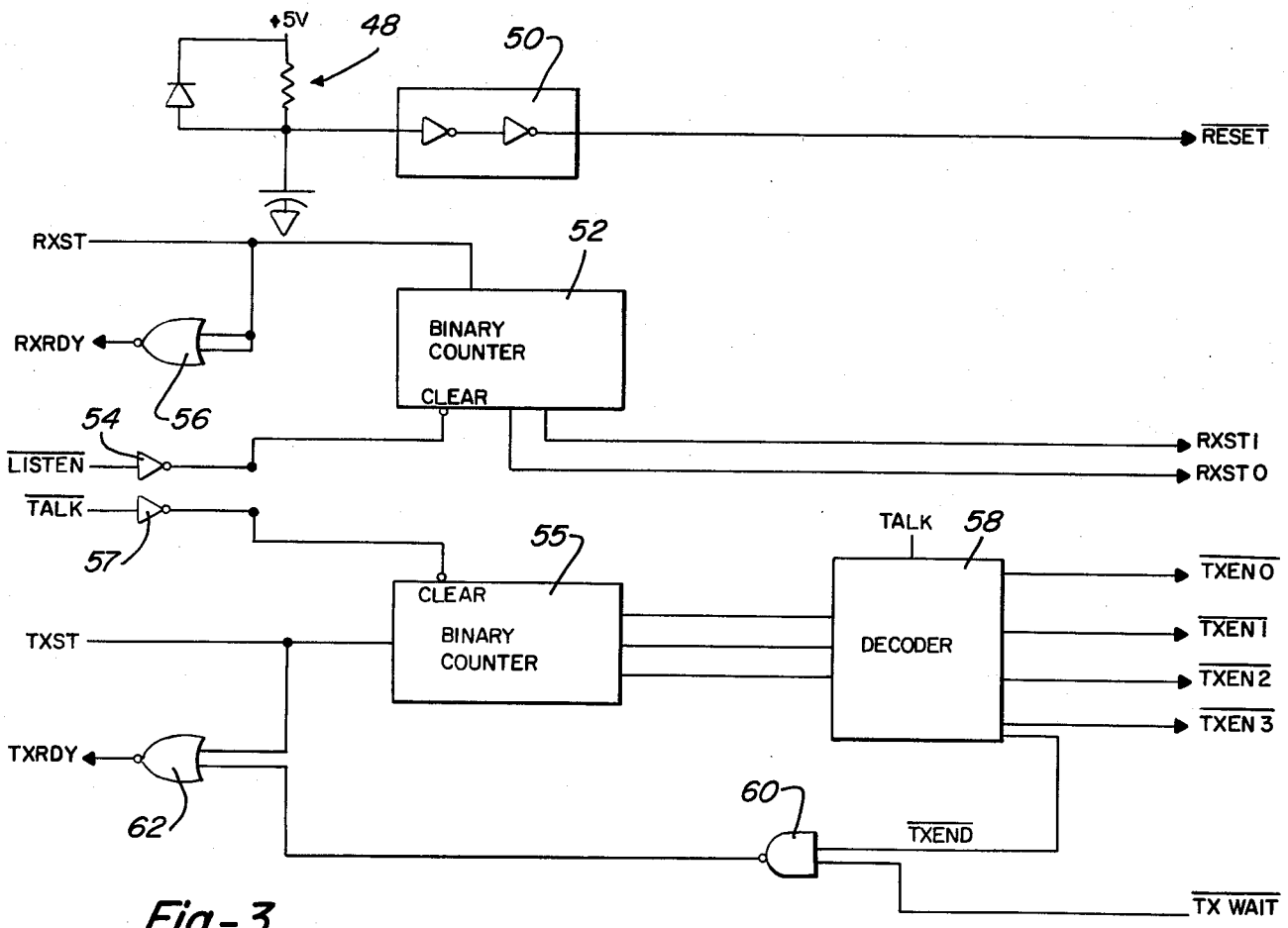
FIG. 3 is a schematic block diagram showing further details of the control module.

Further details of the control module 20 are seen in FIG. 3. A RC circuit 48 and a non-inverting buffer 50 provide a logic LOW $\overline{\text{RESET}}$ signal when power is applied to the system. This logic LOW signal is used to initialize desired gates in the system.

A binary counter 52 counts the number of RXST (receive strobe) signals inputted thereto and outputs a logic HIGH receive strobe signal (RXST0 or RXST1) depending upon the count. The receive strobe signals are used in initiating the sending of information from the computer 18 to the A/D module 16 or the pump/flow module 28. The binary counter 52 is cleared by a logic LOW LISTEN signal generated by the control circuit 38, which is applied to the binary counter 52 through an inverter 54. A NOR gate 56 is provided to generate a RXRDY (receive ready) signal for inputting to the control circuit 38 in order to inform the control circuit 38 that the binary counter 52 has received a receive strobe.

A four bit binary counter 55 counts the number of TXST (transmit strobe) signals received from the control circuit 38. The transmit strobe is generated by the control circuit 38 to indicate that a number of digital bits or a byte of information was received by the computer 18 from a selected one of the modules 16, 28. The binary counter 55 is cleared by a logic LOW TALK signal generated through an Inverter 57. The output of the binary counter 56 is transmitted to a three-line decoder 58. The decoder 58 outputs transmit enable signals ($\overline{\text{TXEN0}}$, $\overline{\text{TXEN1}}$, $\overline{\text{TXEN2}}$ and, $\overline{\text{TXEN3}}$) for use in controlling the sending of data to the computer 18 from the A/D module 16 or pump/flow module 28. The decoder 58 also outputs a $\overline{\text{TXEND}}$ (transmit end) signal to generate a TXRDY signal through NAND gate 60 and NOR gate 62 in order to indicate to the control circuit 38 and computer 18 that all data requests were sent. The NOR gate 62 also inverts the TXST pulse and also provides a TXRDY signal to the control circuit 38.

Figure 4:
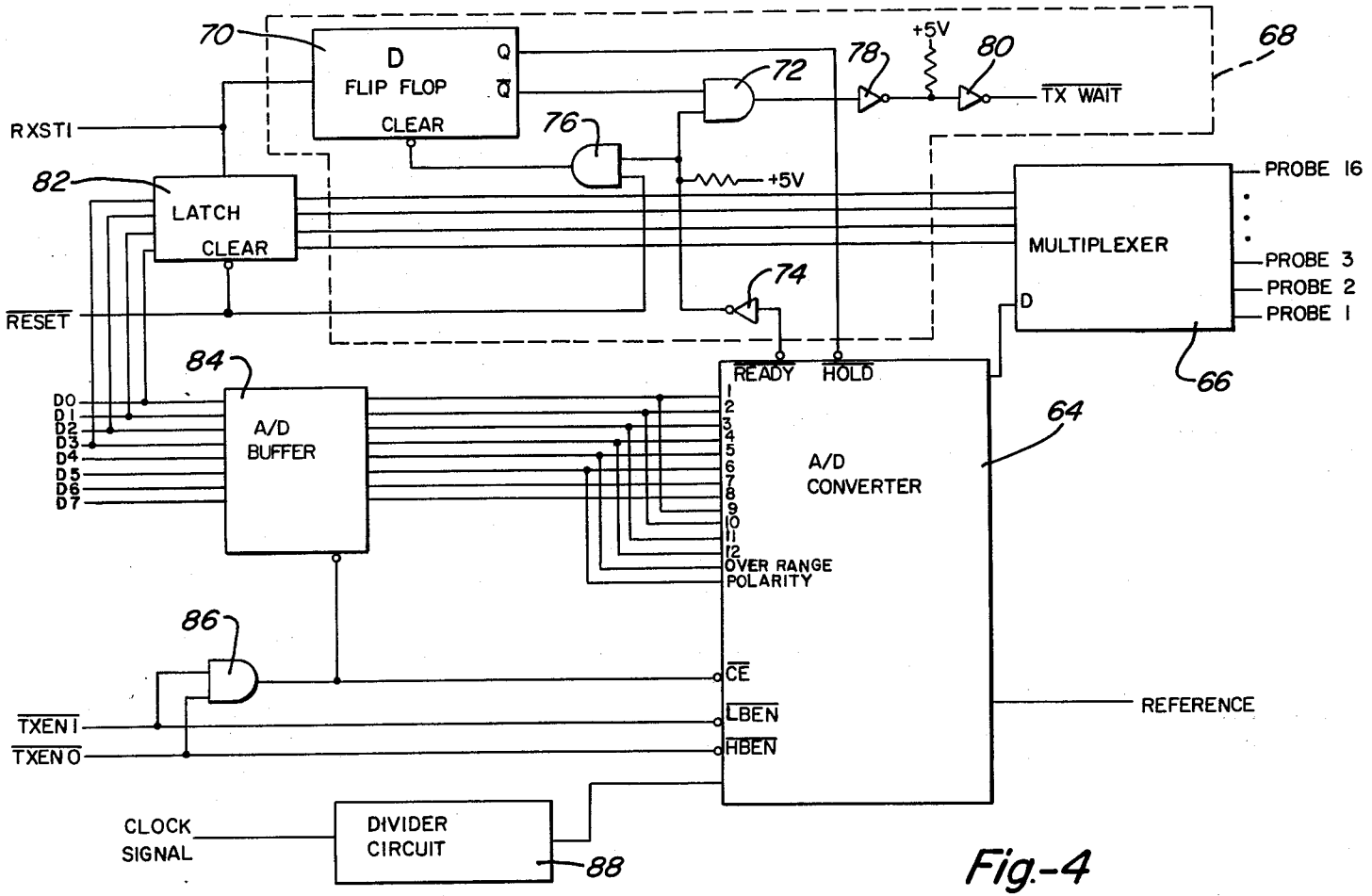
FIG. 4 is a schematic drawing details of the A/D module of the present invention.

The A/D module 16 is more fully illustrated in FIG. 4. An A/D converter 64 receives an analog voltage signal from a multiplexer 66. The multiplexer 66 is used in selecting one of the sixteen wells 10 being monitored for drawdown so that a data signal from the selected well, corresponding to water pressure, is inputted to the A/D converter 64. A control and status circuit 68 is used to initiate the conversion by the A/D converter 64 and report status of the conversion process to the computer 18 and the control circuit 38 by means of the $\overline{\text{TXWAIT}}$ (transmit wait) signal. The control and status circuit 68 includes a D type flip flop 70. The Q output thereof is sent to the $\overline{\text{HOLD}}$ pin of the A/D converter 64. The $\overline{\text{Q}}$ output of the flip-flop 70 is applied to an AND gate 72. The AND gate 72 also responds to an input from Inverter 74, which responds to the $\overline{\text{READY}}$ signal from the A/D converter 64. When the $\overline{\text{READY}}$ signal is a logic HIGH, the A/D converter 64 is busy converting the inputted voltage signal to digital bits. The output from the Inverter 74 is also sent to AND gate 76 for use in clearing the flip-flop 70. The output of AND gate 72 is applied to Inverters 78, 80 to generate the $\overline{\text{TXWAIT}}$ signal.

The A/D module 60 further includes a latch 82 for holding bit information from the computer 18 corresponding to a selected well. The latch 82 outputs four binary bits representing the selected one of the sixteen wells. An A/D buffer 84 provides an interface between the output of the A/D converter 64 and the input to the input buffer 44 of the control module 20. When the computer 18 is requesting data to be sent, the AND gate 86 is used to enable the sending of data from the A/D converter 64 to the computer 18. The clock signal generated by the clock circuit 42 is divided by the divider circuit 88 to provide a proper clock signal for use by the A/D converter 64.

Figure 5:
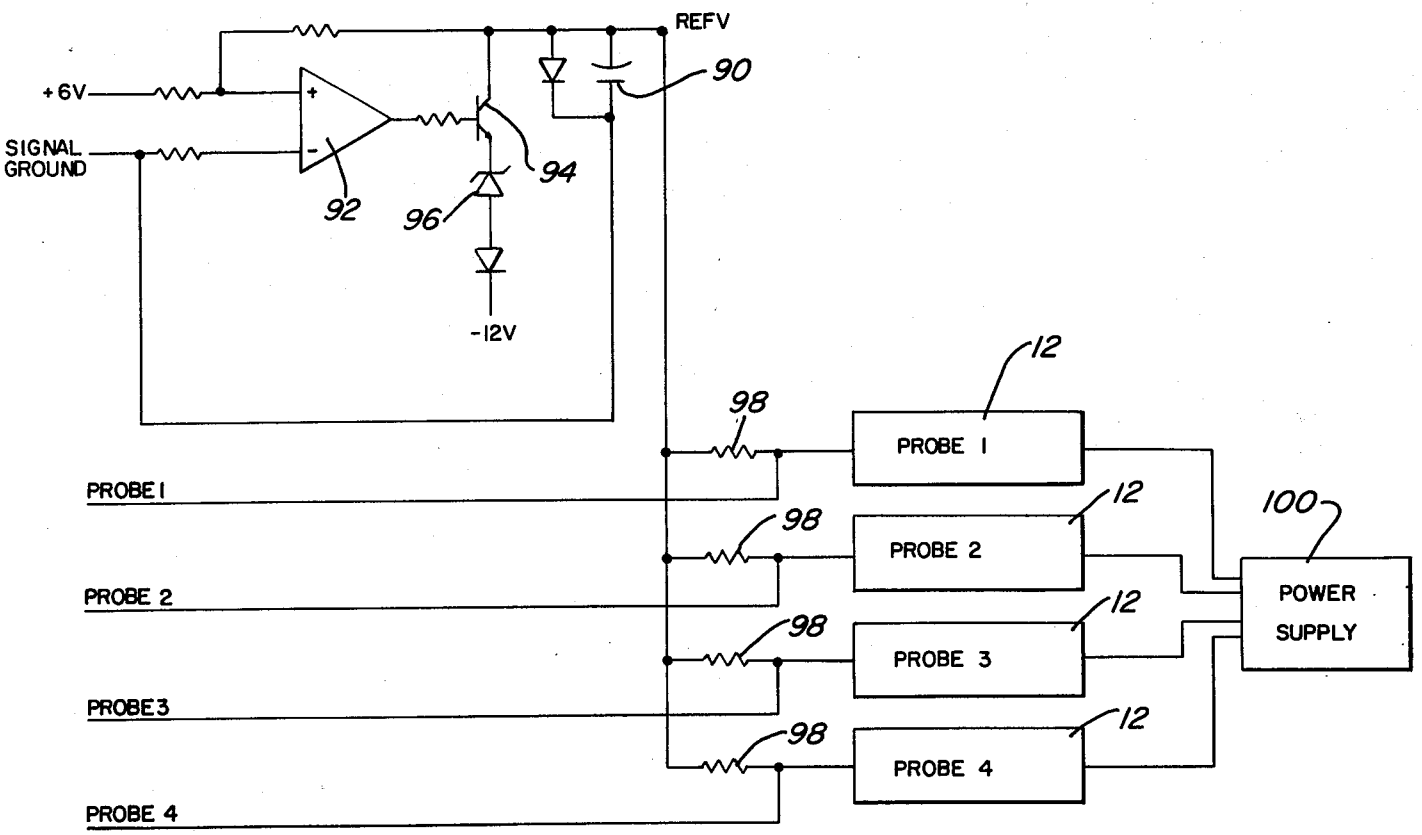
FIG. 5 is a schematic showing details of an input module of the present invention.

A representative one of the four input modules 14 for converting the current signal generated by probes 12 to a voltage signal for transmission to the multiplexer 66 is illustrated in FIG. 5. A reference voltage (REFV) is generated at capacitor 90 using amplifier 92, transistor 94, and zener diode 96. The REFV voltage equals, in one embodiment, −6 volts and is applied to one side of each of four resistors 98. The opposite side of each resistor 98 is connected to one of the four probes 12. Each probe 12 is powered by a power supply 100 which, preferably, outputs +24 volts. The probes 12 generate a current proportional to the water pressure which they sense in the wells 10. The current passes to the resistors 98. The probe signals generated by the current flow through the resistors 98 are analog voltage signals which are sent to the multiplexer 66. The REFV signal is also utilized to indicate to the computer 18 whether the probes 12 are properly connected to the system. If no current is produced by one of the probes 12, for example, an output voltage of −6 volts is applied to the A/D converter 64 when that probe is selected for monitoring. Since the A/D converter 64 expects only voltages in the range of −4 to +4 volts, the A/D converter 64 generates an overrange signal to inform the computer 18 that the selected probe 12 is not functioning properly.

Figure 6:
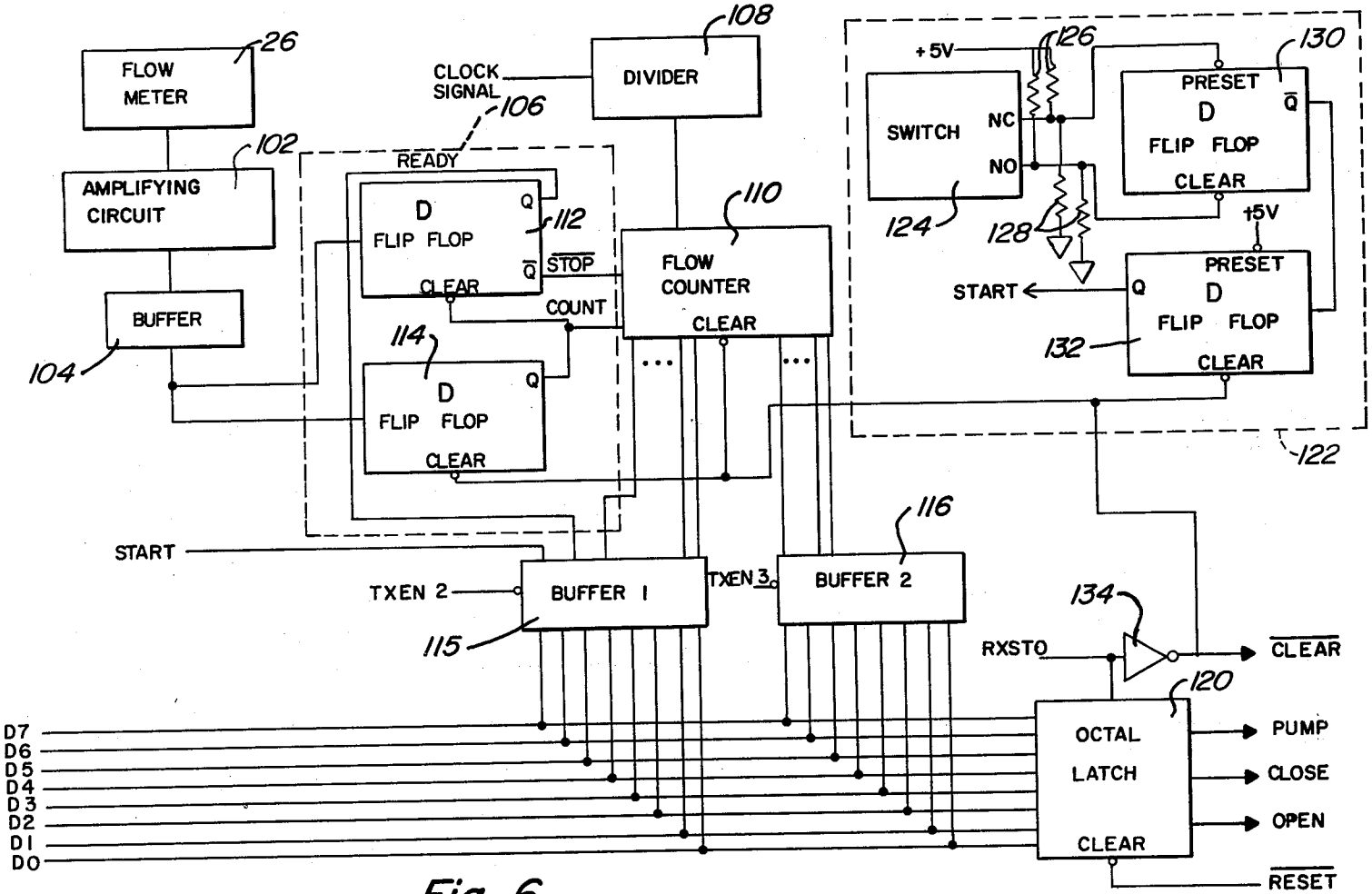
FIG. 6 is a schematic block diagram showing details of the pump/flow module of the present invention.

The pump/flow module 28 is depicted in FIG. 6. As is previously discussed, the flow meter 26 outputs a flow signal having a frequency proportional to the flow rate of water discharged from a well by the pump 22. This flow signal is amplified in an amplifying circuit 102 and then sent to a buffer 104 which shapes the flow signal to a desired square wave configuration. This digital signal is applied to a count control circuit 106. The count control circuit 106 is used to trigger and terminate the counting of clock pulses outputted by a divider 108 to a flow counter 110. The divider 108 responds to the clock signal provided by the control module 20 and divides that signal in order to output a signal having a frequency of 250 KHz. The flow counter 110 counts the number of clock pulses received between each flow signal pulse. The number of clock pulses counted is indicative of the period of the flow signal. The computer software is used to convert the period of the flow signal to a frequency from which a magnitude of flow rate can be determined.

The output of the flow counter 110 includes two bytes of eight bits each. These outputs are applied to buffers for holding the data bits until the information is requested by the computer 18. Buffer 1 115 receives and holds the most significant bits of the bits corresponding to the number of clock pulses counted by the flow counter 110 while Buffer 2 116 receives and holds the least significant bits of the bits corresponding to the number of clock pulses counted by the flow counter 110. Whenever Buffer 1 115 and Buffer 2 116 are enabled, the data bits are sent to the control module 20 and inputted to the input buffer 44.

The count control circuit 106 includes two D-type flip-flops 112, 114. Initially the flip-flops 112, 114 are cleared so that the $\overline{Q}$ output of flip-flop 112 is a logic HIGH and the Q output of flip-flop 114 is a logic LOW. Since flow counter 110 requires both inputs ($\overline{STOP}$ and COUNT) from flip-flops 112, 114, respectively, to be a logic HIGH in order to count clock pulses, no counting occurs. When a first flow pulse is received from Buffer 104 by flip-flop 114, flip-flop 114 is set and Q becomes a logic HIGH. However, $\overline{Q}$ of flip-flop 112 remains a logic HIGH because it is still being held in its clear state by the Q output of flip-flop 114 during the time the first flow pulse is received. As a consequence, both inputs to the flow counter 110 are a logic HIGH and flow counter 110 begins counting clock pulses. Also, the logic HIGH Q output of flip-flop 114 now removes the clear from flip-flop 112. When a second and next flow pulse is received by flip-flop 112, it is now set so that $\overline{Q}$ becomes a logic LOW. Since both inputs are not a logic HIGH at this time, the flow counter 110 stops counting and the inputs to Buffer 1 115 and Buffer 2 116 correspond to the number of clock pulses counted during one period of the flow signal.

An octal latch 120 is also part of the pump/flow module 28 and this latch communicates with the computer 18 through the output buffer 46 of the control module 20 and is used in controlling the opening and closing of the valve 30, as well as, in some embodiments, turning on and off of the pump 22.

A remote switch circuit 122 provides the capability of informing the computer 18 that the pump 22 has been activated so that the computer and control module 20 can begin using the flow rate data provided. The activation of the pump 22 can be controlled either manually by an operator or by using a START signal generated by the remote switch circuit 122. The remote switch circuit 122 includes a switch 124, resistors 126, 128 and a D-type flip-flop 130 which responds to the switch 122. The $\overline{Q}$ output of the flip-flop 130 is sent to another D-type flip-flop 132. The Q output of the flip-flop 132 provides the START signal. The remote switch circuit 122 is devised so that, regardless of the number of times the switch 124 is engaged or pushed by an operator, only one logic HIGH START signal will be generated and applied to the computer 18 through the Buffer 1 115.

The pump/flow module 28 also includes an inverter 134 for use in outputting a $\overline{CLEAR}$ signal which clears the flow counter 110 to a zero value and is also used in resetting the flip-flop 112, 114, and 132. In addition, the Q output of flip-flop 112 provides a READY signal to Buffer 1 115. When this READY signal becomes a logic HIGH, it indicates to the computer 18 that the flow counter 110 has outputted a valid count to the Buffers 115, 116. If the READY signal is a logic LOW, this informs the computer 18 not to compute the flow rate since the count into the buffers 115, 116 is not a valid count.

Figure 7:
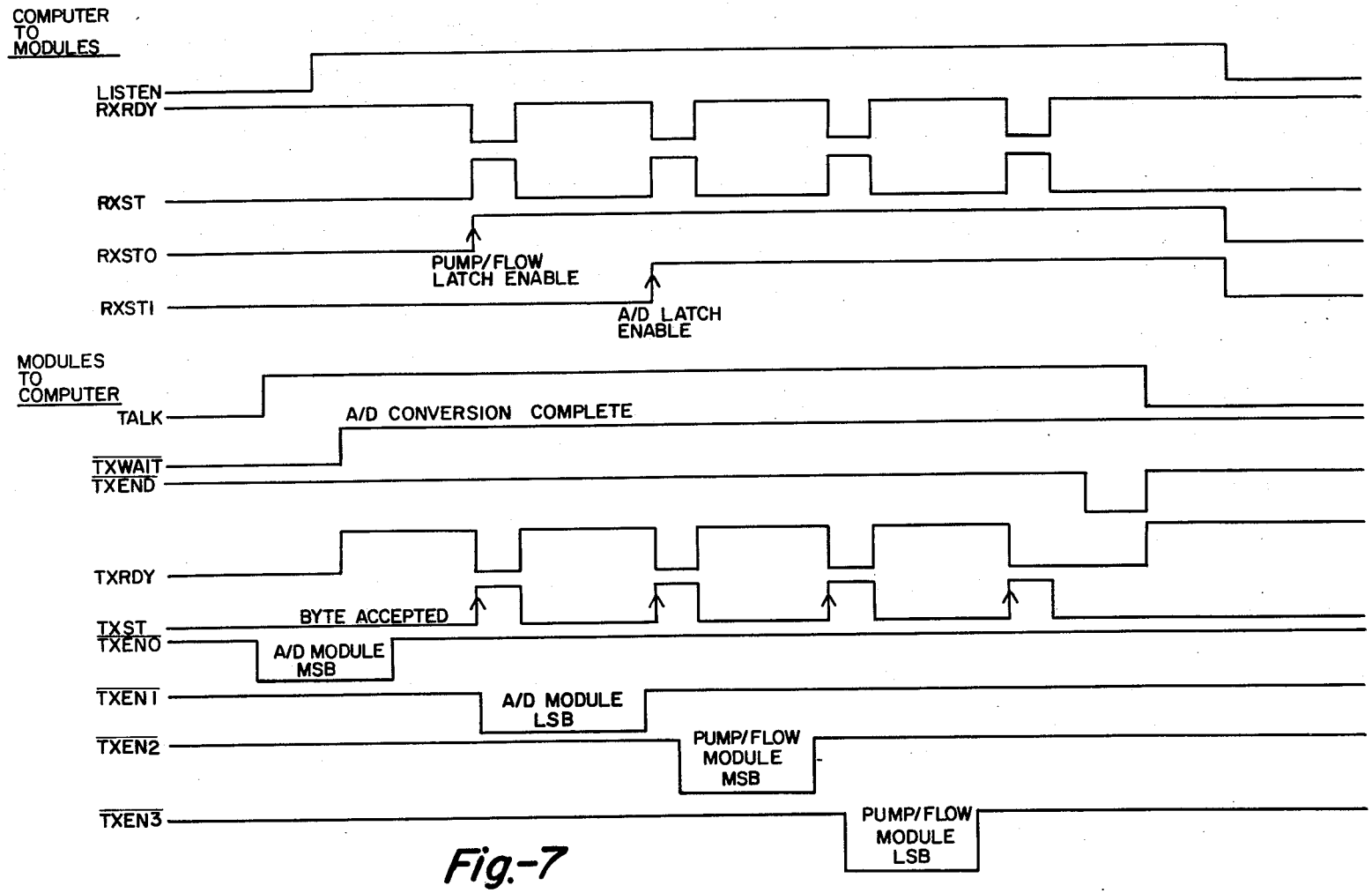
FIG. 7 is a timing diagram showing states of signal waveforms pertinent to the transfer of control and data information between the computer and the modules.

A typical operation of the modules 16, 28, in conjunction with the computer 18, is now provided and reference will be made to the timing diagram of FIG. 7 during this discussion. Initially, an operator inputs necessary parameters using the keyboard 32 for proper operation of the system. Such parameters include identifying the selected well or wells to be monitored, providing the duration of the drawdown test, providing the duration of the recovery test in which the pump 22 is shut off and the water level monitored, selecting the water discharge rate during the drawdown test, and also selecting the sample rate at which monitored data is to be gathered by the computer 18. After desired inputs are provided, the operator initiates the automatic data gathering and reducing features provided by the system. Typically, the switch 124 is activated to generate a logic HIGH START signal. In embodiments in which activation of the pump 22 is provided manually, the pump 22 is manually turned on at this time. The pump 22 is used to remove water from the well and, consequently, the water level in the well changes from a known reference level as a funciton of time during the pumping period.

Also generated at this time is the logic LOW $\overline{\text{RESET}}$ signal by means of the RC circuit 48 and the non-inverting buffer 50. Until the capacitor of the RC circuit 48 is charged sufficiently after application of the five volts, $\overline{\text{RESET}}$ remains a logic LOW. This logic LOW is used to clear flip-flop 70, latch 82, and data latch 120. The $\overline{\text{LISTEN}}$ signal is a logic LOW at this time and it is used to clear binary counter 52. Similarly, the $\overline{\text{TALK}}$ signal is a logic LOW at this time and it is used to clear binary counter 56.

After these gates have been initialized, the computer 18 and control module 20 are ready to begin the task of providing control and data information and receiving data information. In the embodiment in which the activation of the pump 22 is controlled by the computer 18 using the START signal, the computer 18 first addresses the pump flow module 28 for the purpose of sending control information to the pump/flow module 28. The control circuit 38 generates a logic LOW $\overline{\text{LISTEN}}$ signal. This logic LOW removes the clear from binary counter 52 through the Inverter 54. As can be seen from the timing diagram of FIG. 7, the control circuit 38 next generates a logic HIGH RXST signal. This logic HIGH results in one count being received by the binary counter 52. This single count results in the outputting of a logic HIGH RXSTO signal by the binary counter 52. The logic HIGH RXSTO signal generates a logic LOW $\overline{\text{CLEAR}}$ signal by means of the inverter 134 of the pump/flow module 28 of FIG. 6. As noted previously, this logic LOW clears flow counter 110 and flip-flop 112, 114, and 132. The logic HIGH RXSTO signal also enables the octal latch 120 so that control signals from the computer 18 and control module 20 can reach the device to be controlled. In the case of turning on the pump 22, at virtually the same time the RXST signal becomes a logic HIGH and the RXRDY signal becomes a logic LOW, the computer 18 is inputting control information to the control module 20. The IEEE 488 bus 40 outputs the data bits DI01-14 DI08 from the computer 18 to the output buffer 46. Since the $\overline{\text{LISTEN}}$ signal is a logic LOW, output buffer 46 is enabled to allow the bits DO–D7 to be sent to the octal latch 120. In the case of activating the pump 22, the output of the latch 120 is used to turn on the pump 22. After the bits are received by the pump/flow module 28, the RXST signal becomes a logic LOW while the RXRDY signal becomes a logic HIGH indicating that another byte of eight digital bits could be sent to the control module 20.

Next in a typical operation, the computer 18, in conjuction with the control module 20, sends additional bits of control information to tell the remaining portion of the system which well 10 was selected for monitoring drawdown. This is accomplished by the control module 20 outputting another logic HIGH RXST signal (see timing diagram of FIG. 7). This pulse updates the binary counter 52 so that a logic HIGH RXST1 is outputted by the binary counter 52. The RXRDY signal once again becomes a logic LOW to indicate to the control circuit 38 that digital bits are being sent by the computer 18 to the intended module. In this embodiment, the RXST1 logic HIGH is applied to flip-flop 70 and latch 82 of the A/D module 16. Since the output buffer 46 is enabled, the digital bits outputted by the computer 18 are sent to and held by the latch 82. The latch 82 output is transmitted to the multiplexer 66. The latch 82 output is used to select one of the probe 12 outputs being sent to the multiplexer 66. The multiplexer 66 sends the selected output to the A/D converter 64 for converting the analog voltage probe signal to a digital form.

With respect to the control and status circuit 68, the Q output of flip-flop 70 becomes a logic HIGH upon receipt of the logic HIGH RXST1 signal and this logic HIGH Q output is sent to the $\overline{\text{HOLD}}$ pin of the A/D converter 64. In the case where the A/D converter 64 is not at that time in the process of converting an analog voltage signal from the multiplexer 66 to digital bits, the $\overline{\text{READY}}$ signal outputted by the A/D converter 64 is initially a logic LOW. However, the receipt of the logic HIGH Q output by the $\overline{\text{HOLD}}$ pin causes the A/D converter 64 to begin converting the analog signal from the selected probe 12. Consequently, the $\overline{\text{READY}}$ signal becomes a logic HIGH indicating that the conversion is taking place.

After one of the sixteen wells has been selected for gathering water pressure data provided by its probe 12, the computer 18 is ready to receive data from the module 16, 28. The computer 18, together with the control module 20, act to inform the modules 16, 28 that data is to be received from them for analysis. The control circuit 38 causes the $\overline{\text{LISTEN}}$ signal to be a logic HIGH so that the output buffer 46 is disabled. Conversly, the $\overline{\text{TALK}}$ signal becomes a logic LOW. The input buffer 44 is enabled so that data from one of the modules 16, 28 can be received by the computer 18 through the IEEE 488 bus 40. The clear is removed from the binary counter 55 since the TALK signal is now a logic HIGH. The logic HIGH TALK signal also enables the decoder 58 so that the zero output count of the binary counter 56 is decoded to generate a logic LOW $\overline{\text{TXENO}}$ signal. This signal is applied to AND gate 86 to enable A/D buffer 84 and is also applied to A/D converter 64 to enable it for sending the most significant bits (MSD) of the data bits from the A/D converter 64 to the computer 18 through the input buffer 44. The next byte of data is not sent until the control module 18 indicates that the first or MSB byte was sent and accepted. In this regard, the control and status circuit 68 tells the control module 20 whether the A/D converter 64 has completed its conversion process. If the conversion process is not completed, $\overline{\text{TXWAIT}}$ is a logic LOW. When the conversion is completed, the $\overline{\text{READY}}$ signal of the A/D converter 64 becomes a logic LOW. The output of the Inverter 74 is a logic HIGH and is inputted to AND gate 72. The other input to AND gate 72 is also a logic HIGH since flip-flop 70 was cleared at the start of the conversion process. The output of AND gate 72 is a logic HIGH so that the output of the Inverter 80 is a logic HIGH. This logic HIGH $\overline{\text{TXWAIT}}$ signal is applied to NAND gate 60 and then through NOR gate 62. A logic HIGH TXRDY signal is generated and sent to the control circuit 38 to indicate that data bits are being sent to the computer 18.

After the most significant bits corresponding to the water pressure of the selected well are sent, control circuit 38 generates a logic HIGH TXST signal. This logic HIGH results in a one count outputted by the binary counter 56. This one count is decoded by the decoder 58 and it now outputs a logic LOW $\overline{\text{TXEN1}}$ signal. This logic LOW enables A/D converter 64 and A/D buffer 84 so that the least significant bits of data representing sensed water pressure are sent to the computer 18. Data from the A/D converter 64 can be continuously accessed at the inputted sample rate by repeating the foregoing process with respect to the generation of the RXST1 signal so that a number of readings of water pressure are obtained during the pumping cycle and stored in the memory of the computer 18.

From the water pressure data, the software instructions provided in the computer 18 are used to determine the magnitude of drawdown at predetermined time intervals since time is also monitored during the drawdown cycle. Software is provided to further reduce the drawdown data to a form even more useful to hydrologists. Specifically, logarithmic drawdown data points and corresponding logarthmic time can be immediately found and outputted in graph form to the video display 34 or hardcopy 36. Such graphs can be compared with the previously mentioned "type curves" for interpretation of the data.

When it is desired to monitor the water discharge rate produced by the pump 22, the computer 18, together with its software, and control module 20 address the pump/flow module 28 and request that it send data to the computer 18. Consequently, after the least significant bits from the A/D converter 64 have been accepted by the computer 18, a second TXST logic HIGH pulse is outputted by the control circuit 38. This logic HIGH is inputted to the binary counter 55. The count of two outputted by binary counter 55 is applied to the decoder 58, which generates a logic LOW $\overline{\text{TXEN2}}$ This logic LOW is applied to Buffer 1 115 so that the most significant bits of the period of the flow signal are sent to the input buffer 42 of the control module 20. After these bits are accepted, the control module 20 generates a third TXST logic HIGH signal to provide a logic LOW $\overline{\text{TXEN3}}$ signal using binary counter 55 and decoder 58. This logic LOW enables buffer 2 116 for sending the least significant data bits held thereby to the computer 18.

Upon acceptance by the computer 18 of the least significant bits corresponding to a portion of the data representing the period of the flow signal provided by flow meter 26, the control circuit 38 outputs a fourth TXST pulse. As illustrated by the timing diagram of FIG. 7, the decoder 58 now outputs a logic LOW $\overline{\text{TXEND}}$ signal. This logic LOW results in a logic LOW TXRDY signal inputted to the control circuit 38. This logic LOW prevents unwanted information from being sent at this time to the computer 18.

This data relating to the period of the flow signal received by the computer 18 is converted by computer software to a frequency value. From the frequency, the flow rate can be determined using another software algorithm since flow rate is proportional to the frequency of the flow signal. Additional software features compare the measured flow rate provided to the computer 18 by the flow meter 26 with the desired inputted flow or discharge rate. When it is desirable to regulate the flow rate so that it remains essentially constant, the computer 18 and control module 20 act to control the opening and closing of the valve 30. In those instances in which the inputted flow rate is different than the measured flow rate, this feature is provided. Specifically, the $\overline{\text{LISTEN}}$ signal is caused to become a logic HIGH while the $\overline{\text{TALK}}$ signal changes to a logic LOW. As before, a logic HIGH RXST0 signal is generated for enabling octal latch 120 for sending control information from the computer 18 resulting in an opening or closing of the valve 30. If the meassured flow rate is greater than the desired flow rate, the computer 18 produces control information for closing the valve 30. If the measured flow rate is less than the desired flow rate, the computer 18 produces control information for opening the valve 30. Like the drawdown determination, the measured flow rate can be found at time intervals using the inputted sampling rate.

It should also be understood from the foregoing that the computer 18 is programmable so that any number of desired sequences of operation can be provided for monitoring flow rates and drawdown related data and the above discussed sequence sets forth only one such sequence of operation.

Based on the foregoing description then, a number of advantages of the present invention are readily seen. A system for gathering well water data and reducing that data to graphic form in a real time manner is provided. As a consequence, skilled ground water analysts have the opportunity of immediately interpreting monitored data for the purpose of determining the permeability and development of one or more wells. The present invention provides the capability of automatically controlling the rate of water discharge and also the capability of varying water discharge rates. The data gathered using these capabilities further benefits the hydrologist in evaluating the wells under study. The system includes appropriately devised modules for interfacing between monitoring devices and a computer, which reduces data using its extensive software capability.

Although the present invention has been described with reference to a particular embodiment, it is readily understood that variations and modifications can be effected within the spirit and scope of this invention.

What is claimed is:

1. An apparatus for monitoring data associated with well water drawdown and providing a real time reduction of the data, comprising:

a plurality of probe means for providing data related to drawdown of water in wells;

a first module means responsive to said plurality of probe means for selecting one of said probe means and converting data from said selected probe means to a digital form;

computer means for use in reducing the drawdown related data in a real time manner to a graphic form, said computer means including means for providing at least one graphic form for interpretation by one skilled in the ground water field; and second module means communicating with said computer means and said first module means for controlling the transfer of digital data to said computer means from said first module means and for controlling the transfer of control information from said computer means to said first module means.

2. An apparatus, as claimed in claim 1, further including:

flow means for monitoring the discharge rate of water from a well; and third module means communicating with said second module means for use in controlling the discharge rate of water from the well.

3. An apparatus, as claimed in claim 2, wherein:

said third module means includes means responsive to said flow means for determining the period of a flow signal outputted by said flow means.

4. An apparatus, as claimed in claim 2, wherein said third means includes:

first means for counting pulses; and second means communicating with said first means for controlling the counting of said pulses, the number of pulses counted relating to the period of a flow signal outputted by said flow means.

5. An apparatus, as claimed in claim 2, further including:

valve means in operative association with one of said wells and said flow means for controlling the discharge of water from said one of said wells.

6. An apparatus, as claimed in claim 9, wherein:

said third means includes means for latching information from said computer means for use in controlling the opening/closing of said valve means to adjust the discharge rate of water from said one of said wells.

7. An apparatus, as claimed in claim 1, wherein:

said first module means includes input module means responsive to said plurality of probe means for converting signals from said plurality of probe means so that the signals are compatible with said first module means.

8. An apparatus, as claimed in claim 7, wherein:

said input module means includes means for determining whether one of said probe means is operatively associated with said input module means.

9. An apparatus, as claimed in claim 1, wherein:

said graphic form is a logarithmic plot including drawdown as a function of time.

10. An apparatus, as claimed in claim 1, wherein said first module means includes:

means for latching information representing a selected well; and buffer means for use in controlling the outputting of data from said first module means.

11. An apparatus, as claimed in claim 1, wherein:

said first module means includes means communicating with said second module means for informing said second module means regarding whether said first module means is busy converting a signal from one of said plurality of probe means.

12. An apparatus for monitoring data relating to drawdown of water, in conjunction with a number of probes, each probe being placed in a well for monitoring water level change, the apparatus comprising:

A/D module means in communication with the probes for selecting data being sent by one of the probes and for converting the data to a digital form;

control module means communicating with said A/D module means for use in controlling the direction of data and command information between said A/D module means and said control module means; and computer means communicating with said control module means for receiving data provided by said A/D module means and for providing command information to said A/D module means through said control module means, said computer means including means for providing a real time reduction of data from said A/D module means to a logarithmic plot of drawdown as a function of time.

13. An apparatus, as claimed in claim 12, further including:

pump/flow module means communicating with said control module means for use in automatically controlling the discharge rate of water from a well.

14. An apparatus for monitoring data associated with well water drawdown and providing a real time reduction of the data, comprising:

a plurality of probe means for use in providing data signals associated with the drawdown of one or more selected wells, each of the wells having a probe means;

pump means for pumping water from at least one of the wells;

valve means in operative association with said pump means for use in controlling the discharge rate of water from the wells;

flow means in operative association with said valve means for monitoring the discharge rate of water from the well;

input module means responsive to said plurality of probe means for providing compatible data signals;

A/D module means responsive to said input module means and receiving the compatible data signals for selecting one of the wells for monitoring and for converting one of the compatible data signals to a digital form;

pump/flow module means responsive to said flow means for controlling said valve means for use in providing a predetermined water discharge rate from the well;

control module means communicating with said A/D module means and said pump/flow module means for use in controlling the direction of control and data information from and to said A/D module means and said pump/flow module means; and computer means communicating with said control module means for receiving data provided by said A/D module means and said pump/flow module means at virtually the same time the data is outputted by said probe means and said flow means, said computer means using the data in a real time manner for generating graphs which include the parameters of drawdown and time.

15. An apparatus for monitoring data associated with well water drawdown and providing a real time reduction of the data comprising:

first means positioned in one or more wells for providing data related to drawdown of water in the wells;

second means communicating with said first means for use in controlling the direction of data and command information between said first means and said second means; and computer means communicating with said second means for receiving data from said first means and for providing command information to said first means through said second means, said computer means including means for providing a real time reduction of data from said first means to a logarithmic plot of drawdown as a function of time.

16. An apparatus, as claimed in claim 15, further including:

third means communicating with said second means for use in automatically controlling the discharge rate of water from a well.

* * * * *